US006658765B2

(12) United States Patent
Liu

(10) Patent No.: US 6,658,765 B2
(45) Date of Patent: Dec. 9, 2003

(54) EASY-TO-WEAR FOOTWEAR

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 8 days.

(21) Appl. No.: 10/137,896

(22) Filed: May 2, 2002

(65) Prior Publication Data

US 2003/0204968 A1 Nov. 6, 2003

(51) Int. Cl.[7] ..... A43C 11/00

(52) U.S. Cl. ..... 36/50.1; 36/50.1; 36/50.5; 36/138; 24/712; 24/712.1; 24/713.1

(58) Field of Search ..... 36/50.1, 50.5, 36/138; 24/712, 712.1–712.9, 713.1–713.9

(56) References Cited

U.S. PATENT DOCUMENTS 811,316 A * 1/1906 McPherson ..... 36/50.1
4,414,761 A 11/1983 Mahood
5,341,583 A * 8/1994 Hallenbeck ..... 36/50.1
5,425,185 A * 6/1995 Gansler ..... 36/50.1
5,469,640 A 11/1995 Nichols
6,568,104 B2 * 5/2003 Liu ..... 36/50.1

FOREIGN PATENT DOCUMENTS

WO 94/10870 * 5/1994

* cited by examiner

*Primary Examiner*—Ted Kavanaugh
(74) *Attorney, Agent, or Firm*—Frommer, Lawrence & Haug LLP; Matthew K. Ryan

(57) ABSTRACT

A lace tightening assembly on a footwear body includes a base mounted to the footwear body, a rotary member mounted rotatably on the base about a rotary axis, a rotary disc unit mounted co-rotatably on the rotary member, and a lace guiding unit mounted on the rotary disc unit and offset from the rotary axis.

12 Claims, 12 Drawing Sheets

EASY-TO-WEAR FOOTWEAR

BACKGROUND OF THE INVENTION

1. Field of the Invention

The invention relates to a footwear, more particularly to a footwear which is easy to wear and remove.

2. Description of the Related Art

A conventional footwear usually includes a footwear body with a top opening, and a footwear lace. The footwear body includes a vamp, a tongue, and a pair of eyelet tabs. The tongue has a front portion connected to the vamp, and a rear portion extending to the top opening. The tongue further has an opposite pair of lateral sides that extend from the vamp to the top opening. Each of the eyelet tabs is connected to the vamp, and is disposed adjacent to one of the lateral sides of the tongue. Each of the eyelet tabs is formed with a plurality of eyelets that are aligned with each other in a direction from the vamp to the top opening. The footwear lace has a front portion, and a rear portion. The front portion of the footwear lace is strung through the eyelets to form a criss-cross pattern on the eyelet tabs. The rear portion of the footwear lace can be tied together so as to tighten the footwear. However, it is time-wasting to tie and untie the footwear lace when wearing and removing the footwear.

U.S. Pat. No. 5,469,640 discloses a quick adjusting footwear lace system for adjusting footwear lace tension in a single movement. Referring to FIGS. 1 and 2, the footwear lace system disclosed in this U.S. patent includes a cinch plate 3 having eyelets 301 which are spaced apart by about the same distance as eyelets 201 formed in the eyelet tabs of the footwear. The footwear lace 1 is strung through the eyelets 301 at the cinch plate 3 along with the eyelets 201 in the eyelet tabs of the footwear. A strap 4, fixably attached at a lower end to the footwear body 2 and loopable at an upper end through a slot in the cinch plate 3, is used to adjustably pull the cinch plate 3 and the footwear lace 1 looped through the eyelets 301 downwardly and thus increase the footwear lace tension so as to tighten the footwear. However, the footwear lace system disclosed in this U.S. patent is merely configured to adjust tension of the footwear lace, and does not facilitate wearing and removal of the footwear.

U.S. Pat. No. 4,414,761 discloses a footwear having an improved closure. Referring to FIGS. 3 and 4, the closure of the footwear 6 disclosed in this U.S. patent includes a first elongate area 601 provided with a plurality of eyelets, a second non-apertured elongate area 602 provided with a male VELCRO™ fastener 702, a footwear lace 5, and a panel 7 provided with a plurality of eyelets corresponding to the eyelets of the first elongate area 601 and a female VELCRO™ fastener 701 on the inner surface of the panel 7. The footwear lace 5 is strung through the eyelets of the first elongate area 601 and the eyelets of the panel 7 to form a criss-cross pattern. The panel 7 can releasably engage the second non-apertured elongate area 602 through the engagement between the male and female fasteners 702, 701.

Although the footwear disclosed in U.S. Pat. No. 4,414,761 facilitates wearing and removal of the footwear, the VELCRO™ fasteners are liable to loosen during use and easily accumulate dirt thereon.

SUMMARY OF THE INVENTION

Therefore, the object of the present invention is to provide a footwear which is easy to wear and remove and which does not employ VELCRO™ fasteners.

The footwear according to this invention includes a footwear body, a lace tightening assembly, and a footwear lace unit.

The footwear body has a top opening, and includes a vamp, and first and second eyelet tabs connected to the vamp. The first eyelet tab is formed with a plurality of eyelets. The second eyelet tab includes a front portion proximate to the vamp, a rear portion proximate to the top opening, and an intermediate eyelet-free portion between the front and rear portions of the second eyelet tab. Each of the front and rear portions of the second eyelet tab is provided with at least one eyelet.

The lace tightening assembly includes a base mounted to the second eyelet tab at the eyelet-free portion, a rotary member mounted rotatably on the base about a rotary axis, a rotary disc unit mounted co-rotatably on the rotary member, and a lace guiding unit mounted on the rotary disc unit and offset from the rotary axis.

The footwear lace unit has a first portion and a second portion. The first portion of the footwear lace unit is strung through the eyelets of the first eyelet tab and the eyelets of the second eyelet tab, and is drawn around the lace guiding unit to form a criss-cross pattern on the first and second eyelet tabs. The second portion of the footwear lace unit is disposed proximate to the top opening.

The rotary member is rotatable relative to the base in a footwear tightening direction, in which a part of the first portion of the footwear lace unit drawn around the lace guiding unit rotates with the rotary disc unit about the rotary axis to wind the first portion of the footwear lace unit on the rotary member to increase tension of the footwear lace unit, and a footwear loosening direction opposite to the footwear tightening direction, in which said part of the first portion of the footwear lace unit is unwound from the rotary member to slacken the footwear lace unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
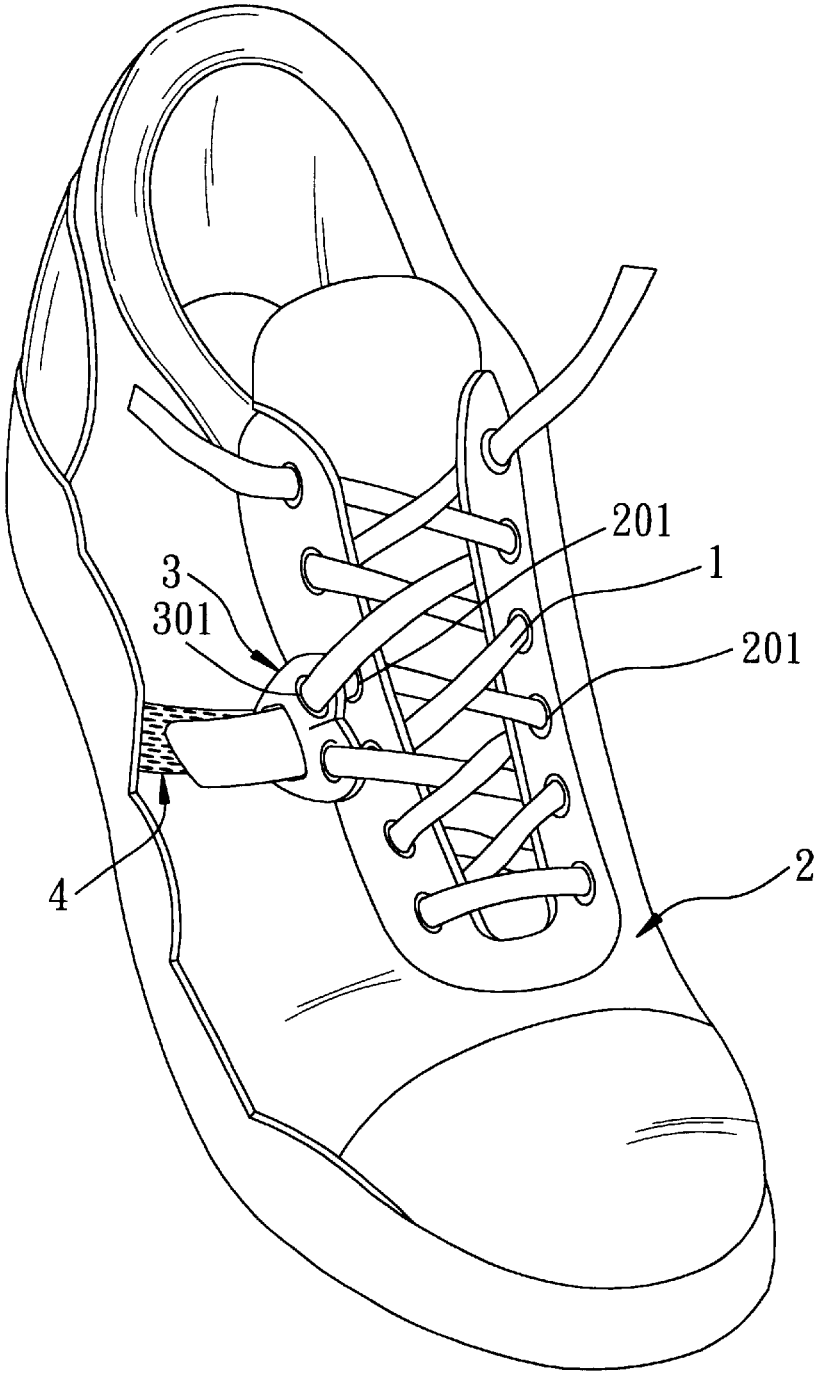
FIG. 1 PRIOR ART
FIG. 1 is a perspective view of a conventional footwear disclosed in U.S. Pat. No. 5,469,640.
Figure 2:
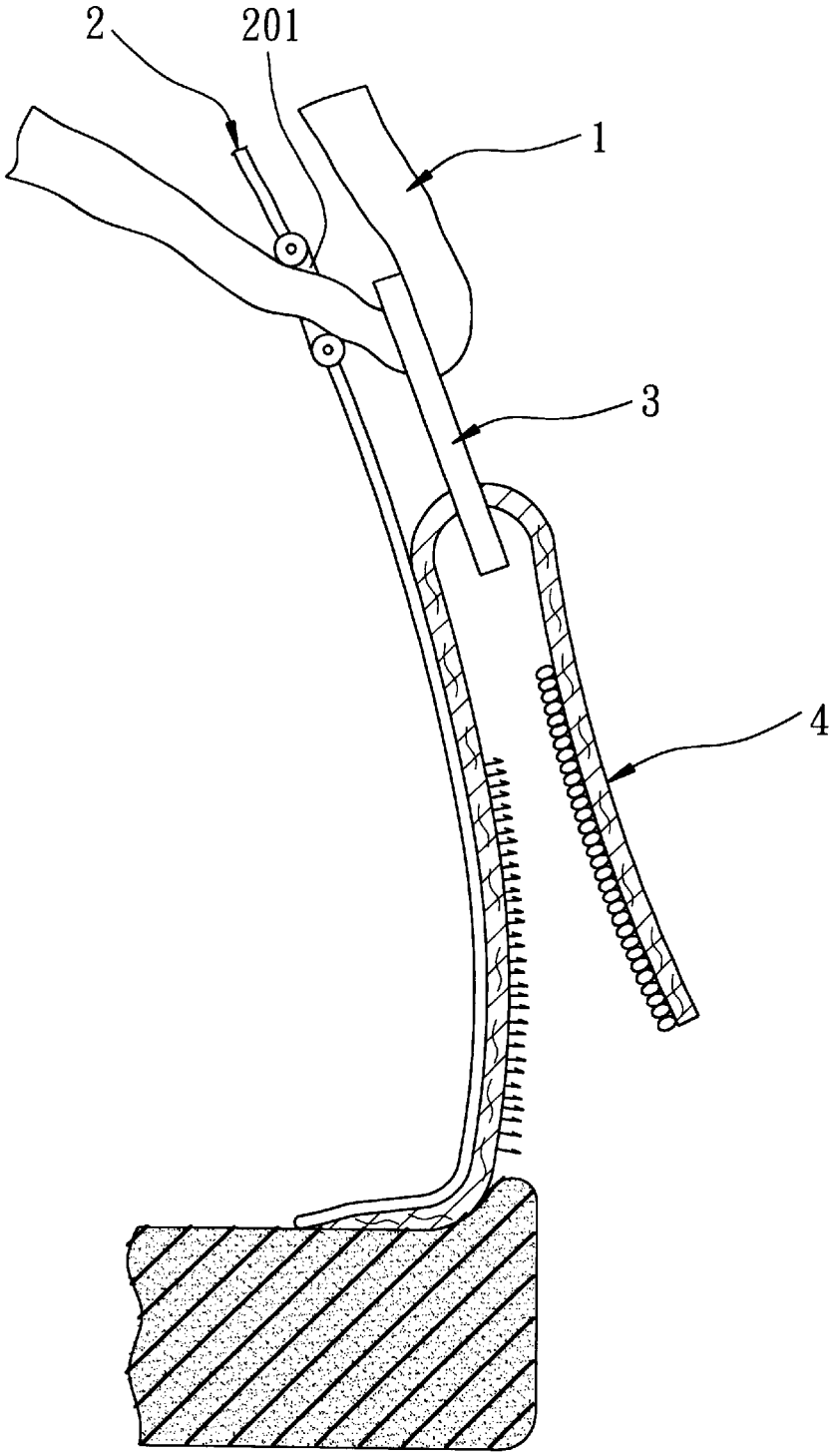
FIG. 2 PRIOR ART
FIG. 2 is a fragmentary sectional view of the footwear of FIG. 1.
Figure 3:
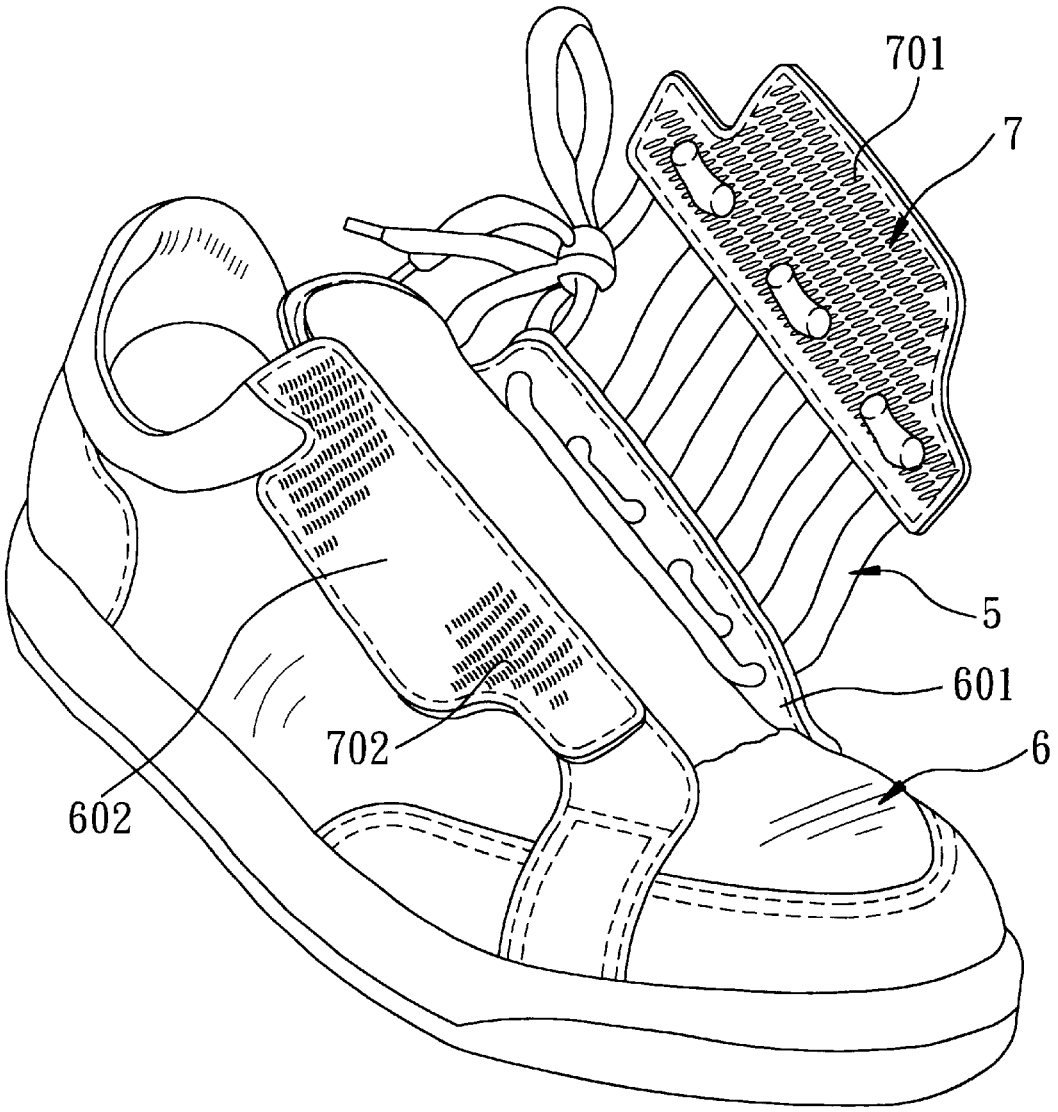
FIG. 3 PRIOR ART
FIG. 3 is a perspective view of another conventional footwear disclosed in U.S. Pat. No. 4,414,761 in an opened state.
Figure 4:
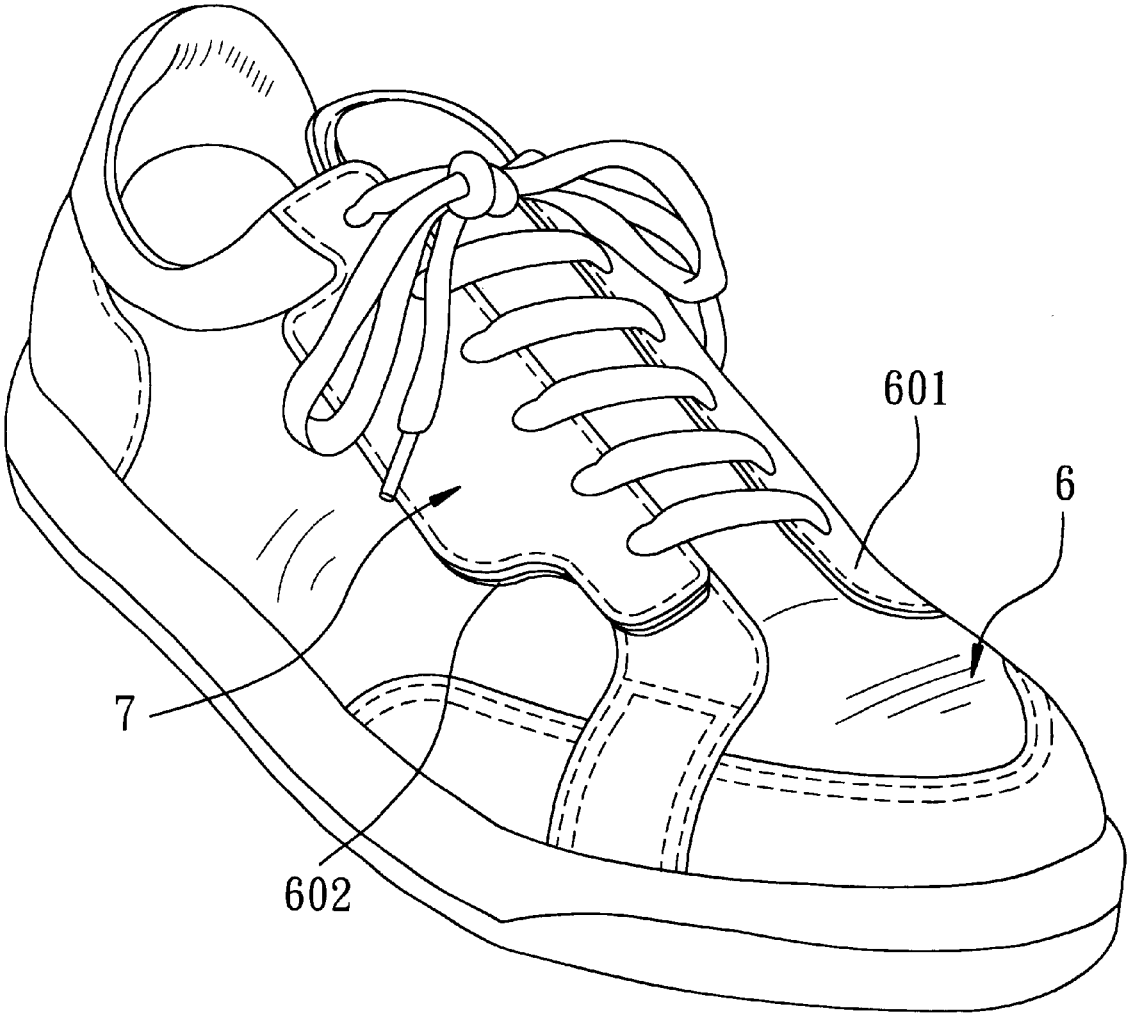
FIG. 4 PRIOR ART
FIG. 4 is a perspective view of the footwear of FIG. 3 in a closed state.
Figure 5:
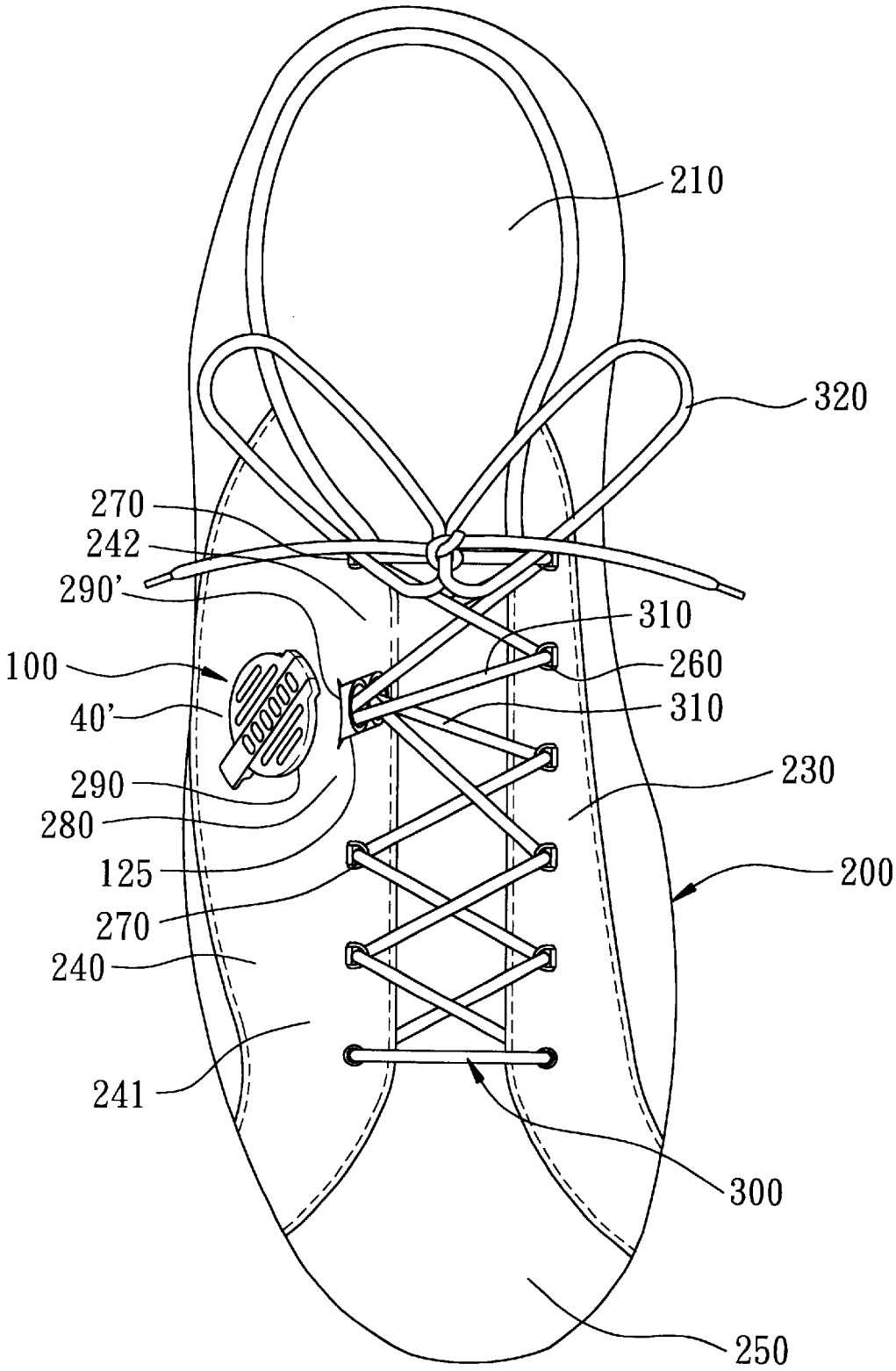
FIG. 5 is a top view of the preferred embodiment of a footwear according to this invention in a tightened state.
Figure 6:
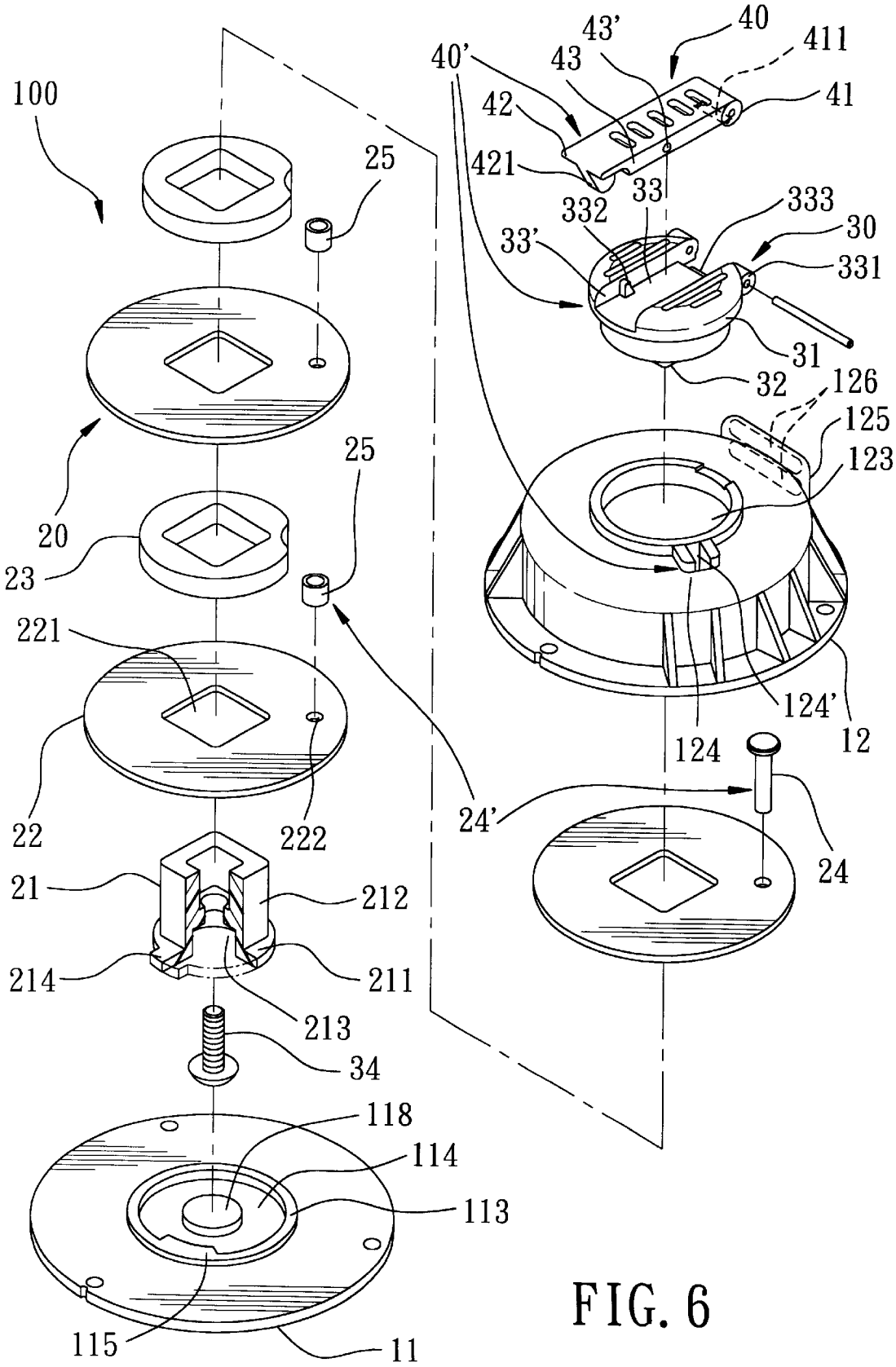
FIG. 6 is an exploded perspective view of a lace tightening assembly of the preferred embodiment of FIG. 5.

Referring to FIGS. 5 and 6, the preferred embodiment of the footwear according to this invention is shown to include a footwear body 200, a lace tightening assembly 100, and a footwear lace unit 300.

The footwear body 200 has a top opening 210, and includes a vamp 250, and first and second eyelet tabs 230, 240 connected to the vamp 250. The first eyelet tab 230 is formed with a plurality of eyelets 260. The second eyelet tab 240 includes a front portion 241 proximate to the vamp 250, a rear portion 242 proximate to the top opening 210, and an intermediate eyelet-free portion 280 between the front and rear portions 241, 242 of the second eyelet tab 240. The front portion 241 of the second eyelet tab 240 is provided with a plurality of eyelets 270. The rear portion 242 of the second eyelet tab 240 is provided with an eyelet 270. The intermediate eyelet-free portion 280 of the second eyelet tab 240 is formed with a blind hole 290 and a slot 290'.

The lace tightening assembly 100 can be mounted on the eyelet-free portion 280 of the second eyelet tab 240, or embedded within the eyelet-free portion 280 of the second eyelet tab 240, as shown in FIG. 5. Referring to FIG. 6, the lace tightening assembly 100 includes: a base 11 mounted to the second eyelet tab 240 at the eyelet-free portion 280; a rotary member 21 mounted rotatably on the base 11 about a rotary axis; a rotary disc unit 20 mounted co-rotatably on the rotary member 21; and a lace guiding unit 24' mounted on the rotary disc unit 20 and offset from the rotary axis.

Figure 8:
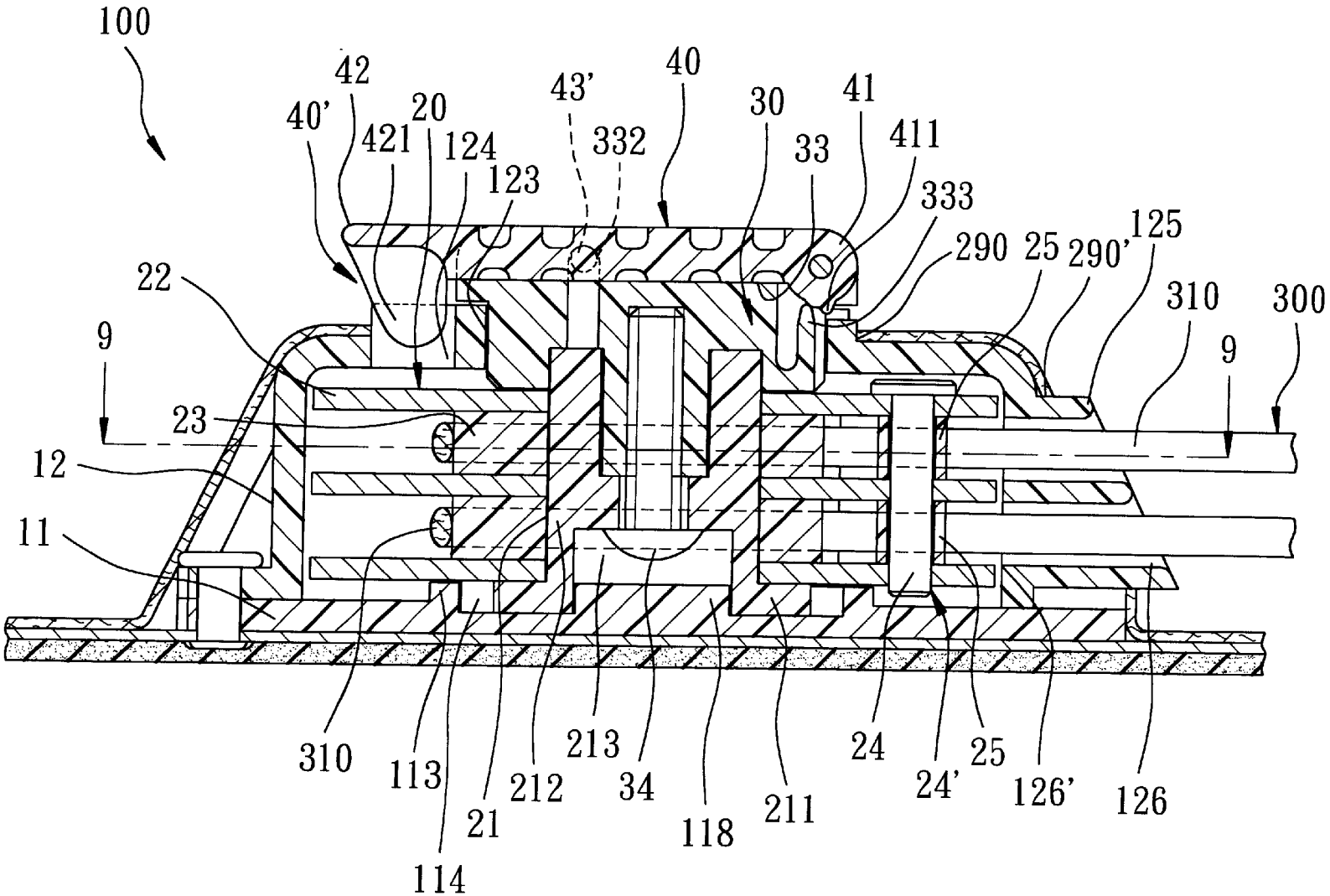

Referring again to FIG. 5, the footwear lace unit 300 has a first portion 310 and a second portion 320. The first portion 310 of the footwear lace unit 300 is strung through the eyelets 260 of the first eyelet tab 230 and the eyelets 270 of the second eyelet tab 240, and is drawn around the lace guiding unit 24' (as best shown in FIG. 8) to form a criss-cross pattern on the first and second eyelet tabs 230, 240. The second portion 320 of the footwear lace unit 300 is disposed proximate to the top opening 210.

Figure 7:
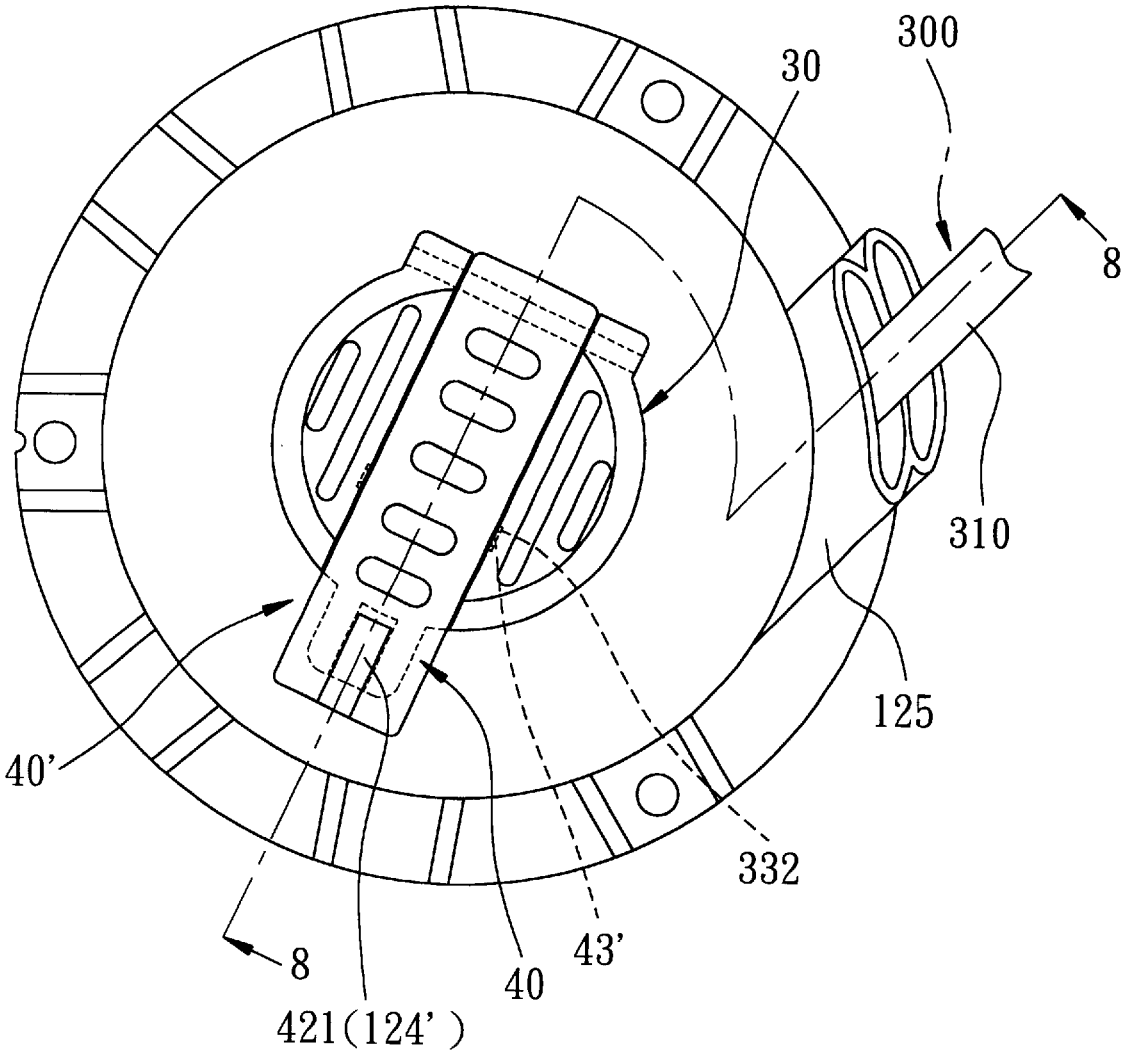
FIGS. 7, 8 and 9 illustrate the lace tightening assembly of FIG. 6 in a lace tightening state.
Figure 9:
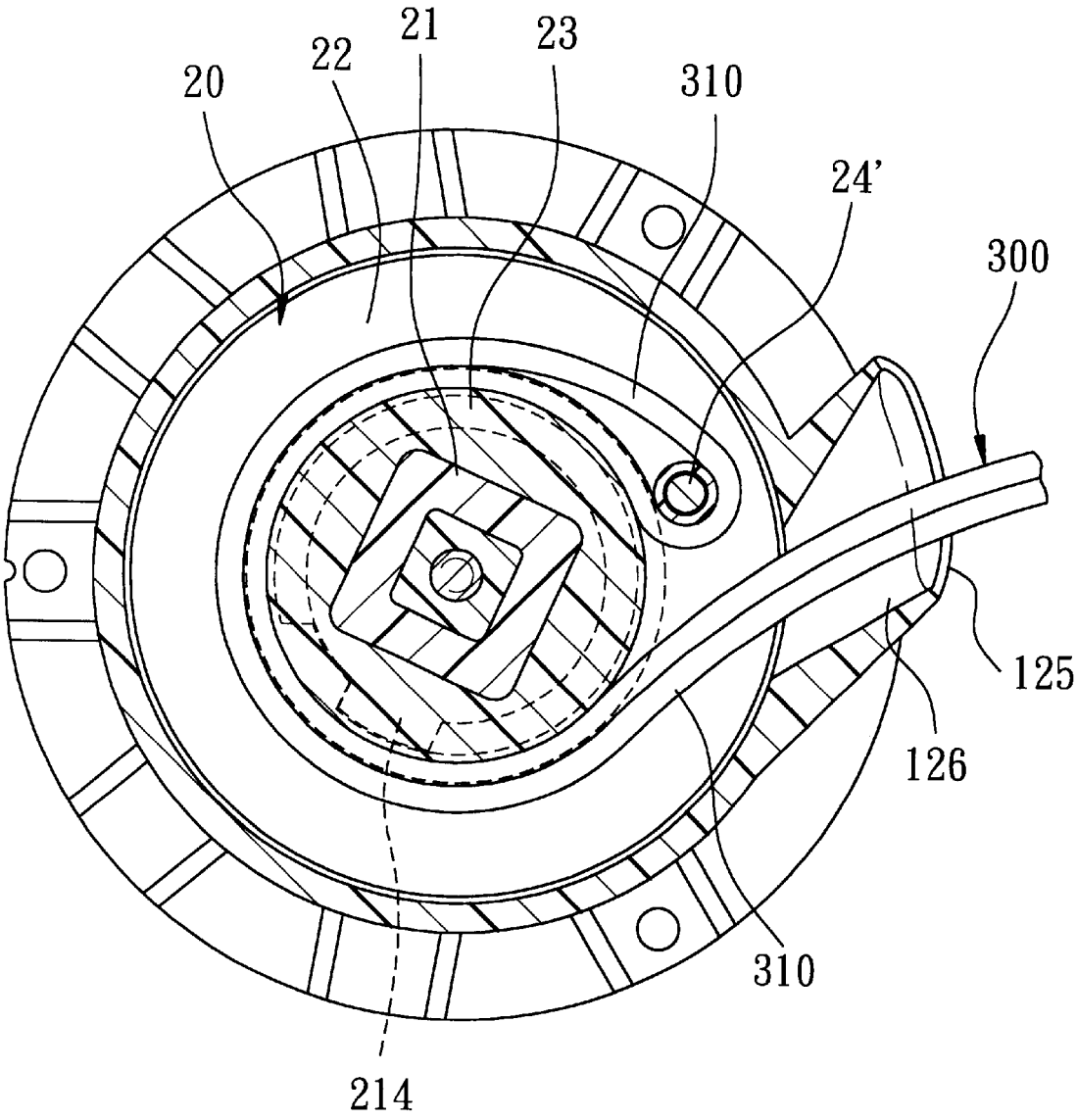
Figure 11:
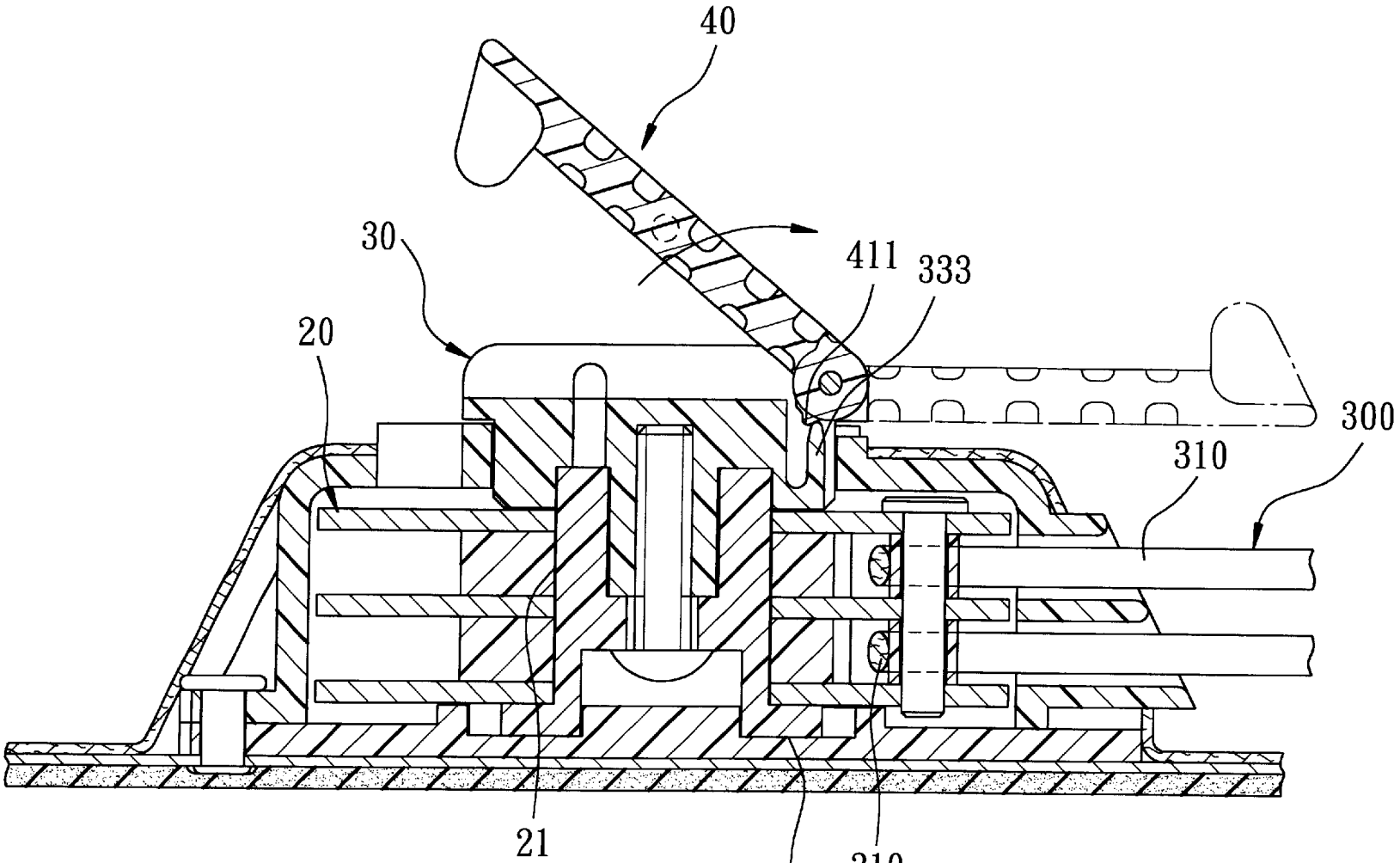
FIGS. 11 and 12 illustrate the lace tightening assembly of FIG. 6 in a lace loosening state.
Figure 12:
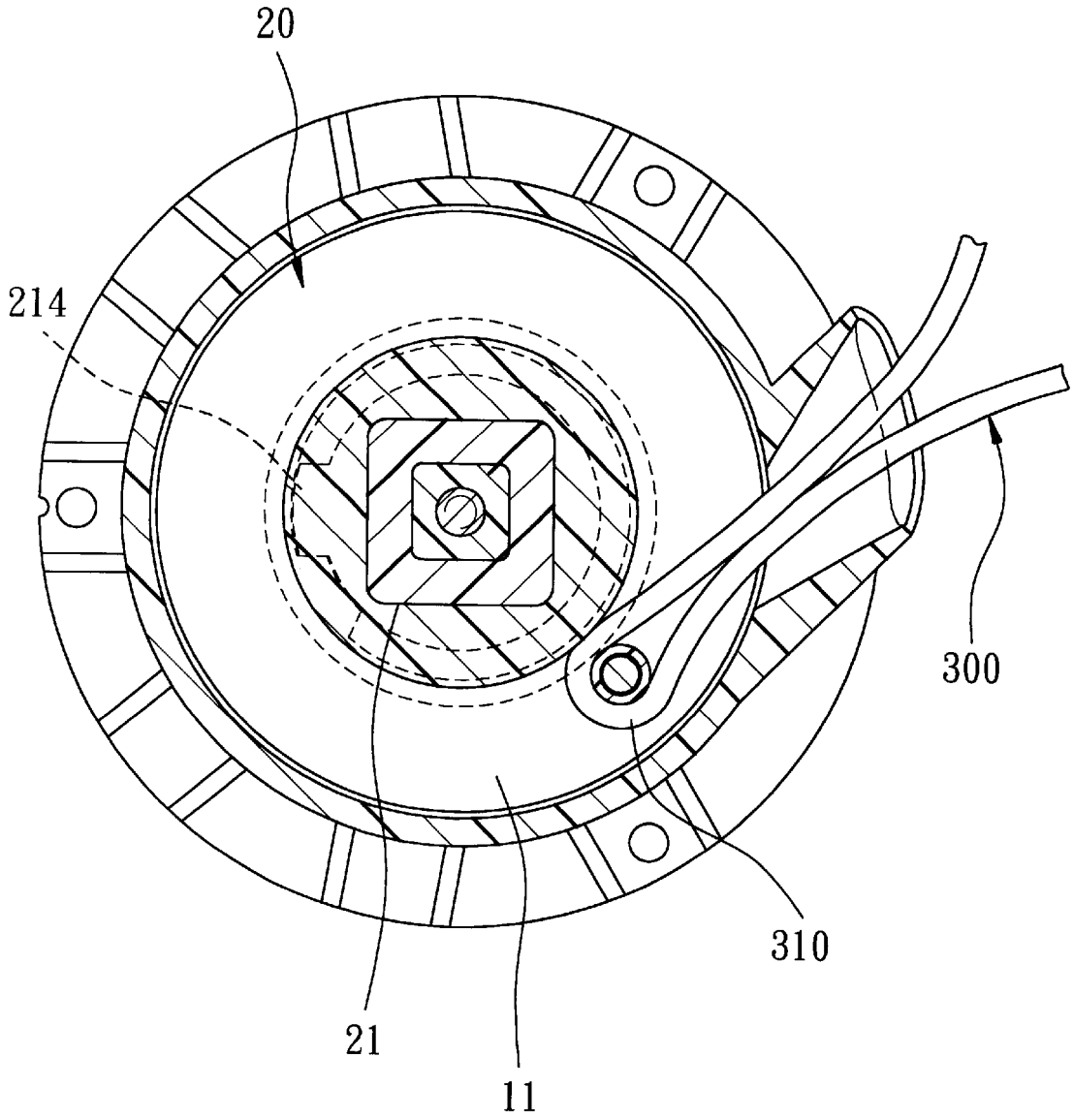

The rotary member 21 is rotatable relative to the base 11 in a footwear tightening direction, as shown in FIGS. 7, 8 and 9, in which a part of the first portion 310 of the footwear lace unit 300 drawn around the lace guiding unit 24' rotates with the rotary disc unit 20 about the rotary axis to wind the first portion 310 of the footwear lace unit 300 on the rotary member 21 to increase tension of the footwear lace unit 300, and a footwear loosening direction opposite to the footwear tightening direction, as shown in FIGS. 11 and 12, in which said part of the first portion 310 of the footwear lace unit 300 is unwound from the rotary member 21 to slacken the footwear lace unit 300.

Referring to FIGS. 6 and 8, the rotary member 21 has a non-circular cross section, and the rotary disc unit 20 has a coupling hole 221 corresponding to the non-circular cross section of the rotary member 21 so as to couple the rotary disc unit 20 to the rotary member 21. The base 11 is formed with an axle 118 projecting upwardly therefrom, and an annular recess 114 around the axle 118. The annular recess 114 is defined by a ring 113 projecting upwardly from the base 11. The rotary member 21 has a top part 212 coupled to the rotary disc unit 20, and a bottom part 211 rotatably confined within the annular recess 114 of the base 11 and formed with an axle recess 213 for coupling rotatably with the axle 118 on the base 11. Furthermore, the annular recess 114 of the base 11 is formed with a radial inward stop flange 115 that projects from the ring 113 toward the axle 118. The bottom part 211 of the rotary member 21 has a radial outward stop block 214 that cooperates with the stop flange 115 so as to limit rotation of the rotary member 21 about the axle 118 in the footwear tightening and footwear loosening directions.

The rotary disc unit 20 includes a plurality of alternately disposed discs 22 and spacers 23. Each of the discs 22 and the spacers 23 is formed with a coupling hole 221 for coupling co-rotatably with the rotary member 21. The lace guiding unit 24' includes a guide pin 24 extending through the discs 22 via holes 222 and offset from the rotary axis, and a plurality of bushings 25, each of which is sleeved on the guide pin 24 and is disposed between an adjacent pair of the discs 22.

The lace tightening assembly 100 further includes a cap 12 mounted on the base 11 to conceal the rotary member 21 and the rotary disc unit 20 between the cap 12 and the base 11.

Referring to FIGS. 5, 6 and 8, the lace tightening assembly 100 further includes a tubular guide 125 extending from the cap 12 toward the first eyelet tab 230 via the slot 290'. The tubular guide 125 has opposite open ends 126, 126' that are respectively distal and proximate to the first eyelet tab 230 and that permit the first portion 310 of the footwear lace unit 300 to extend into the cap 12 for drawing around the lace guiding unit 24'.

The lace tightening assembly 100 further includes a retaining unit 40' mounted on the rotary member 21 and the cap 12 for retaining releasably the rotary member 21 in a lace tightening position relative to the base 11. The cap 12 is formed with a top opening 123 coaxial with the rotary member 21. The retaining unit 40' includes a rotary button 30, a positioning seat 124, and a lever 40. The rotary button 30 has a bottom portion 32 received within the opening 123 in the cap 12 and coupled co-rotatably to the rotary member 21 via a screw 34, and a top portion 31 opposite to the bottom portion 32 and disposed outwardly of the cap 12. The positioning seat 124 is disposed adjacent to the top opening 123 in the cap 12 and is formed with an engaging groove 124'. The lever 40 has a pivot end 41 coupled pivotally to the button 30 and an engaging end 42 formed with a downwardly projecting flange 421 for engaging releasably the engaging groove 124' in the positioning seat 124 when the rotary member 21 is disposed in the lace tightening position to arrest rotation of the rotary member 21 relative to the base 11, as shown in FIGS. 7, 8 and 9. The lever 40 is operable to facilitate rotation of the rotary member 21 relative to the base 11 when disengaged from the positioning seat 124. As shown in FIGS. 11 and 12, the lever 40 may be used to rotate the rotary member 21 relative to the base 11 from the footwear loosening direction to the footwear tightening direction.

The top portion 31 of the rotary button 30 is formed with a slot 33 for receiving the lever 40 therein. The slot 33 has a pair of confronting slot walls 33', each of which is formed with an engaging recess 332. The lever 40 has opposite sides 43 formed respectively with an engaging bead 43' to engage removably the engaging recess 332 in an adjacent one of the slot walls 33' when the lever 40 is disposed to engage the positioning seat 124. Moreover, the rotary button 30 is formed with an upright resilient rod 333 that extends toward the pivot end 41 of the lever 40. The pivot end 41 is formed with a radial projection 411 that is movable past the resilient rod 333 when the lever 40 is pivoted relative to the rotary button 30 between an engaging position, as shown in FIG. 8, in which the lever 40 is disposed in the slot 33 in the top portion 31 of the rotary button 30 and engages the engaging groove 124' in the positioning seat 124, and a disengaging position, as shown in FIG. 11, in which the lever 40 is disengaged from the engaging groove 124' in the positioning seat 124 and extends out of the slot 33 in the top portion 31 of the rotary button 30.

Figure 10:
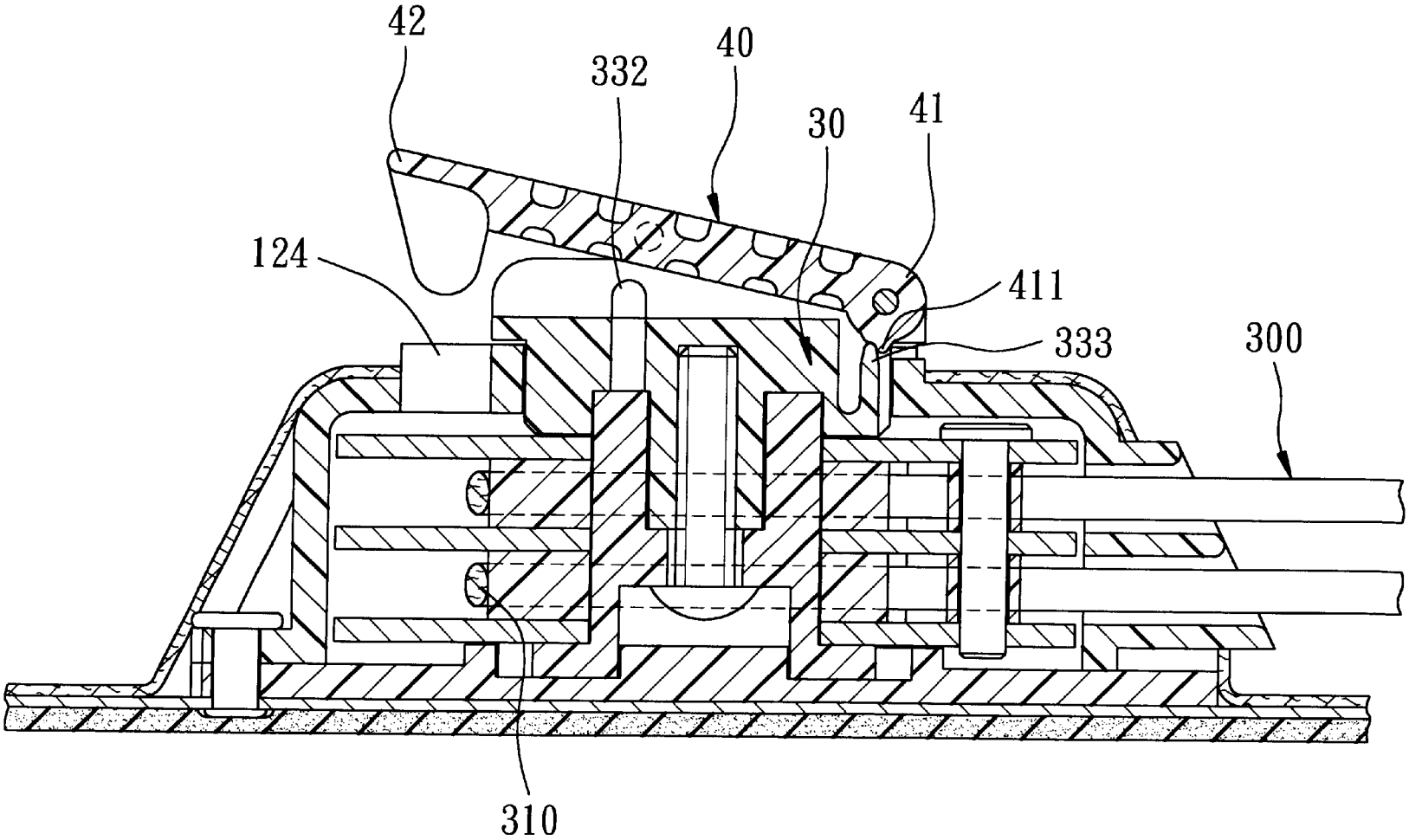
FIG. 10 is a sectional view of the lace tightening assembly of FIG. 6 at an instant in which a lever and a positioning seat of the lace tightening assembly are disengaged from each other.

Referring to FIG. 10, when the user intends to take off the footwear, the engaging end 42 of the lever 40 is disengaged from the positioning seat 124. The radial projection 411 on the pivot end 41 of the lever 40 can be stopped by the resilient rod 333 on the rotary button 30 when the footwear lace unit 300 is loosened from the lace tightening position, thereby preventing injury to the user due to sudden rotation of the lever 40.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A footwear, comprising:

a footwear body having a top opening, said footwear body including a vamp, and first and second eyelet tabs connected to said vamp, said first eyelet tab being formed with a plurality of eyelets, said second eyelet tab including a front portion proximate to said vamp, a rear portion proximate to said top opening, and an intermediate eyelet-free portion between said front and rear portions of said second eyelet tab, each of said front and rear portions of said second eyelet tab being provided with at least one eyelet;

a lace tightening assembly including a base mounted to said second eyelet tab at said eyelet-free portion, a rotary member mounted rotatably on said base about a rotary axis, a rotary disc unit mounted co-rotatably on said rotary member, and a lace guiding unit mounted on said rotary disc unit and offset from said rotary axis; and a footwear lace unit having a first portion and a second portion, said first portion of said footwear lace unit being strung through said eyelets of said first eyelet tab and said eyelets of said second eyelet tab and being drawn around said lace guiding unit to form a criss-cross pattern on said first and second eyelet tabs, said second portion of said footwear lace unit being disposed proximate to said top opening;

said rotary member being rotatable relative to said base in a footwear tightening direction, in which a part of said first portion of said footwear lace unit drawn around said lace guiding unit rotates with said rotary disc unit about said rotary axis to wind said first portion of said footwear lace unit on said rotary member to increase tension of said footwear lace unit, and a footwear loosening direction opposite to the footwear tightening direction, in which said part of said first portion of said footwear lace unit is unwound from said rotary member to slacken said footwear lace unit.

2. The footwear as claimed in claim 1, wherein said rotary member has a non-circular cross section, and said rotary disc unit has a coupling hole corresponding to said non-circular cross section of said rotary member so as to couple said rotary disc unit to said rotary member.

3. The footwear as claimed in claim 1, wherein said base is formed with an axle projecting upwardly therefrom and an annular recess around said axle, said rotary member having a top part coupled to said rotary disc unit, and a bottom part rotatably confined within said annular recess of said base and formed with an axle recess for coupling rotatably with said axle on said base.

4. The footwear as claimed in claim 3, wherein said annular recess of said base is formed with a radial inward stop flange that projects toward said axle, said bottom part of said rotary member having a radial outward stop block that cooperates with said stop flange so as to limit rotation of said rotary member about said axle in the footwear tightening and footwear loosening directions.

5. The footwear as claimed in claim 1, wherein said rotary disc unit includes a plurality of alternately disposed discs and spacers, each of said discs and said spacers being formed with a coupling hole for coupling co-rotatably with said rotary member.

6. The footwear as claimed in claim 5, wherein said lace guiding unit includes a guide pin extending through said discs and offset from said rotary axis, and a plurality of bushings, each of which is sleeved on said guide pin and is disposed between an adjacent pair of said discs.

7. The footwear as claimed in claim 1, wherein said lace tightening assembly further includes a cap mounted on said base to conceal said rotary member and said rotary disc unit between said cap and said base.

8. The footwear as claimed in claim 7, wherein said lace tightening assembly further includes a tubular guide extending from said cap toward said first eyelet tab, said guide having opposite open ends that are respectively distal and proximate to said first eyelet tab and that permit said part of said first portion of said footwear lace unit to extend into said cap.

9. The footwear as claimed in claim 7, wherein said lace tightening assembly further includes a retaining unit mounted on said rotary member and said cap for retaining releasably said rotary member in a lace tightening position relative to said base.

10. The footwear as claimed in claim 9, wherein said cap is formed with a top opening coaxial with said rotary member, said retaining unit including a rotary button having a bottom portion received within said opening in said cap and coupled co-rotatably to said rotary member, and a top portion opposite to said bottom portion and disposed outwardly of said cap, a positioning seat disposed adjacent to said top opening in said cap and formed with an engaging groove, and a lever having a pivot end coupled pivotally to said button and an engaging end for engaging releasably said engaging groove in said positioning seat when said rotary member is disposed in the lace tightening position to arrest rotation of said rotary member relative to said base, said lever being operable to facilitate rotation of said rotary member relative to said base when disengaged from said positioning seat.

11. The footwear as claimed in claim 10, wherein said top portion of said rotary button is formed with a slot for receiving said lever therein, said slot having a pair of confronting slot walls, each of which is formed with an engaging recess, said lever having opposite sides formed respectively with an engaging bead to engage removably said engaging recess in an adjacent one of said slot walls when said lever is disposed to engage said positioning seat.

12. The footwear as claimed in claim 10, wherein said rotary button is formed with an upright resilient rod that extends toward said pivot end of said lever, said pivot end being formed with a radial projection that is movable past said resilient rod when said lever is pivoted relative to said rotary button between an engaging position, in which said lever is disposed in said slot in said top portion of said rotary button and engages said engaging groove in said positioning seat, and a disengaging position, in which said lever is disengaged from said engaging groove in said positioning seat and extends out of said slot in said top portion of said rotary button.

* * * * *